US009301044B2

(12) United States Patent
Takayasu et al.

(10) Patent No.: US 9,301,044 B2
(45) Date of Patent: Mar. 29, 2016

(54) ACOUSTIC APPARATUS

(71) Applicant: KABUSHIKI KAISHA TOSHIBA, Minato-ku, Tokyo (JP)

(72) Inventors: Toshiki Takayasu, Kanagawa-ken (JP); Osamu Nishimura, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 240 days.

(21) Appl. No.: 13/921,694

(22) Filed: Jun. 19, 2013

(65) Prior Publication Data

US 2014/0023206 A1 Jan. 23, 2014

(30) Foreign Application Priority Data

Jul. 23, 2012 (JP) ..... 2012-162784

(51) Int. Cl.
*H04R 1/40* (2006.01)
*H04R 1/34* (2006.01)

(52) U.S. Cl.
CPC ..... *H04R 1/345* (2013.01); *H04R 1/403* (2013.01); *H04R 2217/03* (2013.01)

(58) Field of Classification Search
CPC ..... H04R 27/00; H04S 1/0002
USPC ..... 381/77, 78, 97, 80, 82, 160
See application file for complete search history.

(56) References Cited

U.S. PATENT DOCUMENTS 6,229,899 B1 * 5/2001 Norris ..... G10K 15/02 381/77
6,445,804 B1 * 9/2002 Hirayanagi ..... H04R 3/00 381/117
7,167,415 B2 * 1/2007 Neeson et al. ..... 367/138
2003/0215103 A1 * 11/2003 Norris et al. ..... 381/77
2006/0109989 A1 * 5/2006 Linhard ..... G10K 11/28 381/160

FOREIGN PATENT DOCUMENTS

JP 8-149592 A 6/1996
JP 11-127495 5/1999

OTHER PUBLICATIONS

Office Action of Notice of Reasons for Refusal for Japanese Patent Application No. 2014-203519 dated Sep. 4, 2015, 5 pages.

* cited by examiner

*Primary Examiner* — Disler Paul
(74) *Attorney, Agent, or Firm* — Amin, Turocy & Watson, LLP

(57) ABSTRACT

According to one embodiment, an amplitude modulation unit generates a first signal by modulating an amplitude of a carrier wave signal having a frequency of an ultrasonic band, based on an acoustic signal. A phase control unit generates a second signal and a third signal by controlling a phase of the first signal. Respective phases of the second signal and the third signal are approximately opposite. A first parametric loudspeaker radiates a first sound wave toward a first control point, based on the second signal. A first reflection unit has a first concave to receive a sound wave and reflect the sound wave toward the first control point. A focal point of the sound wave reflected by the first concave is the first control point. A second parametric loudspeaker radiates a second sound wave toward the first concave, based on the third signal.

8 Claims, 12 Drawing Sheets

ACOUSTIC APPARATUS

CROSS-REFERENCE TO RELATED APPLICATION

This application is based upon and claims the benefit of priority from Japanese Patent Application No. 2012-162784, filed on Jul. 23, 2012; the entire contents of which are incorporated herein by reference.

FIELD

Embodiments described herein relate generally to an acoustic apparatus having a super-directivity.

BACKGROUND

As to an acoustic apparatus having a super-directivity by using a parametric loudspeaker, in order to separate a listening area for a listener to listen sounds from a non-listening area not to listen sounds, various methods are proposed. For example, it is desired that the listening area and the non-listening area are separated along a propagation direction of sound. In this case, by using two parametric loudspeakers from which sound waves having the same characteristic of sound pressure-distribution are radiated, the sound waves from respective parametric loudspeakers are interfered. As a result, sound pressures of the sound waves at the non-listening area are cancelled.

However, in above-mentioned method, a cancel amount of the sound pressure becomes large at not only the non-listening area but also the listening area. Accordingly, at the listening area, it is difficult that a sound pressure of a synthesis sound interfered is sufficiently maintained.

DETAILED DESCRIPTION

According to one embodiment, an acoustic apparatus includes an amplitude modulation unit, a phase control unit, a first parametric loudspeaker, a first reflection unit, and a second parametric loudspeaker. The amplitude modulation unit is configured to generate a first signal by modulating an amplitude of a carrier wave signal having a frequency of an ultrasonic band, based on an acoustic signal. The phase control unit is configured to generate a second signal and a third signal by controlling a phase of the first signal. Respective phases of the second signal and the third signal are approximately opposite. The first parametric loudspeaker is configured to radiate a first sound wave toward a first control point, based on the second signal. The first reflection unit has a first concave to receive a sound wave and reflect the sound wave toward the first control point. A focal point of the sound wave reflected by the first concave is the first control point. The second parametric loudspeaker is configured to radiate a second sound wave toward the first concave, based on the third signal.

Various embodiments will be described hereinafter with reference to the accompanying drawings.

The First Embodiment

Figure 1:
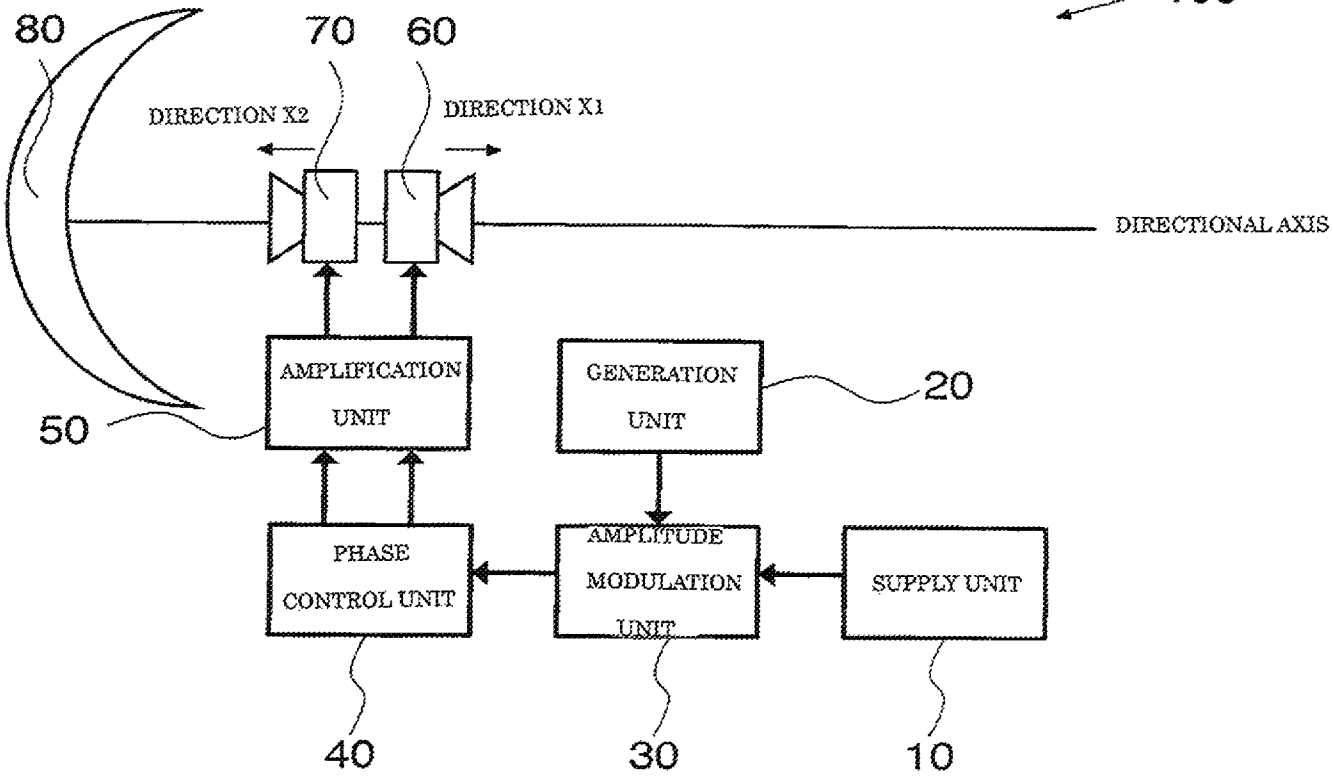
FIG. 1 is a block diagram of an acoustic apparatus according to a first embodiment.
Figure 12A:
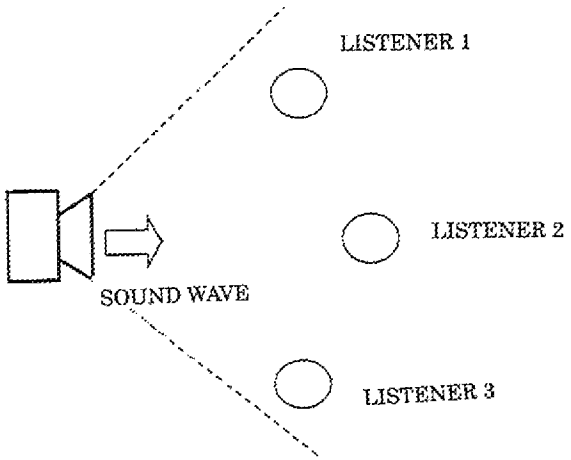
FIGS. 12A and 12B are schematic diagrams to explain a conventional loudspeaker and a parametric loudspeaker.
Figure 12B:
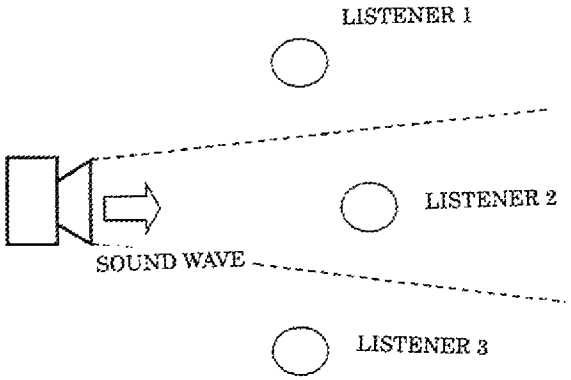

FIG. 1 is a block diagram of an acoustic apparatus 100 according to the first embodiment. For example, the acoustic apparatus 100 is used for speech guidance of an electric advertisement or an exhibition hall. In situation that such speech guidance is desirably presented only to a part of listeners, a listening area thereof had better be limited. Briefly, as to a conventional loudspeaker shown in FIG. 12A, a sound wave radiated therefrom is diffused, and the speech guidance is informed to all listeners existing around there. Accordingly, in the acoustic apparatus 100, a parametric speaker which radiates a directive sound wave is used. As a result, as shown in FIG. 12B, the speech guidance can be informed only to a part of listeners.

Furthermore, in the acoustic apparatus 100 of the first embodiment, by interfering sound waves of which characteristic of sound pressure-distribution are different, a distance at which the speech guidance arrives can be controlled. Here, an area for listeners to listen the speech guidance is called a listening area. Furthermore, an area for listeners not to listen the speech guidance is called a non-listening area.

In the acoustic apparatus 100 shown in FIG. 1, a supply unit 10 supplies an acoustic signal such as a speech guidance to an amplitude modulation unit 30. A generation unit 20 generates a carrier wave signal having a frequency of ultrasonic band. Furthermore, the amplitude modulation unit 30 modulates an amplitude of the carrier wave signal (generated by the generation unit 20) by using the acoustic signal (supplied by the supply unit 10). By controlling a phase of a first amplitude modulation signal (modulated by the amplitude modulation unit 30), a phase control unit 40 generates a second amplitude modulation signal and a third amplitude modulation signal of which mutual phases are approximately opposite. Furthermore, an amplification unit 50 amplifies the second amplitude modulation signal and the third amplitude modulation signal.

A first parametric loudspeaker 60 radiates a first sound wave toward a predetermined control point, based on the second amplitude modulation signal (amplified by the amplification unit 50). Furthermore, a second parametric loudspeaker 70 radiates a second sound wave based on the third amplitude modulation signal (amplified by the amplification unit 50). A reflection unit 80 reflects the second sound wave (radiated by the second parametric loudspeaker 70), and focuses the second sound wave at the predetermined control point.

While the first sound wave (radiated by the first parametric loudspeaker 60) and the second sound wave (radiated by the second parametric loudspeaker 70) are propagated in the air, a waveform distortion occurs therein, and an audible sound same as the acoustic signal is demodulated. Here, an audible sound demodulated from the first sound wave is called a first audible sound, and an audible sound demodulated from the second sound wave is called a second audible sound.

Briefly, in the acoustic apparatus 100 shown in FIG. 1, the first audible sound demodulated from the first sound wave (radiated by the first parametric loudspeaker 60) and the second audible sound demodulated from the second sound wave (radiated by the second parametric speaker 70 and reflected by the reflection unit 80) are synthesized, and a listener can listen a synthesis sound thereof as the speech guidance. Here, by differentiating characteristic of sound pressure-distribution of the first audible sound and the second audible sound, and by interfering the first audible sound and the second audible sound, the sound pressure-distribution of the synthesis sound is controlled. As a result, the listener can control a range for the listener able to listen to the synthesis sound.

Here, as a boundary between the listening area and the non-listening area, a control point is previously fixed at a predetermined position along a first direction from the side of the first parametric loudspeaker 60. As a result, a sound pressure of the first audible sound is attenuated steeply at the control point. Furthermore, it is confirmed that the sound pressure once attenuated at the control point is maintained as a low value. Briefly, in the first embodiment, by using this phenomenon, the audible area and the non-audible area are mutually separated.

Hereinafter, component of the acoustic apparatus 100 shown in FIG. 1 is explained in detail.

The supply unit 10 acquires an acoustic signal as a source sound, and supplies the acoustic signal to the amplitude modulation unit 30. As a method for the supply unit 10 to acquire the acoustic signal, various techniques can be considered. For example, by previously recording a speech (and so on) with a microphone, the acoustic signal can be acquired. Furthermore, for example, by terrestrial broadcasting or satellite broadcasting such as TV, audio equipment or AV equipment, contents including the acoustic signal can be acquired. For example, contents including the acoustic signal only, contents including the acoustic signal with a moving image or a still image, and contents including another relational information therewith, can be acquired (Hereinafter, they are simply called contents). The contents may be acquired via network such as Internet, Intranet, or Home network. Furthermore, the contents may be acquired by reading from a recording medium such as an internal disk device.

The generation unit 20 generates a carrier wave signal including a frequency of ultrasonic band. Moreover, as the frequency of ultrasonic band, a frequency for a person unable to listen is necessary. Accordingly, for example, a frequency larger than 20 kHZ is defined.

The amplitude modulation unit 30 obtains the acoustic signal from the supply unit 10, and obtains the carrier wave signal from the generation unit 20. By modulating amplitude of the carrier wave signal with the acoustic signal, the amplitude modulation unit 30 generates a first amplitude modulation signal. Here, a signal s(t) represented by following equation is generated.

$$S(t)=A_c(1+ms(t))\cos(2\pi f_c t+\phi_c) \quad (1)$$

$A_c$: amplitude of carrier wave signal $f_c$: frequency of carrier wave signal $\phi_c$: initial phase of carrier wave signal m: modulation factor s(t): acoustic signal As one example, if a sign wave is selected as the acoustic signal, s(t) is represented by following equation.

$$S(t)=A_s \sin(2\pi f_s t) \quad (2)$$

$A_s$: amplitude of acoustic signal $f_s$: frequency of acoustic signal

Moreover, as a means for acquiring the amplitude modulation signal, except for above-mentioned technique, several methods can be utilized. For example, a method to expect improvement of sound quality of the parametric loudspeaker, such as SSB method, MDSB method, or VSB method, can be applied. The amplitude modulation unit 30 supplies the first amplitude modulation signal to the phase control unit 40.

The phase control unit 40 obtains the first amplitude modulation signal from the amplitude modulation unit 30. By controlling a phase of the first amplitude modulation signal, the phase control unit 40 generates a second amplitude modulation signal and a third amplitude modulation signal. When the second amplitude modulation signal and the third amplitude modulation signal are overlapped in the listening area, phases thereof are mutually opposite (or approximately opposite). It is desired that a phase difference between the second amplitude modulation signal and the third amplitude modulation signal is 180°. However, the phase difference may be permitted within an error range that a sound pressure of synthesis sound at the control point is below a predetermined threshold (For example, a minimum audible sound pressure: $2\times10^{-5}$ Pa). Here, for example, the phase control unit 40 can make a phase of the second amplitude modulation signal be equal to a phase of the first amplitude modulation signal, and change a phase of the third amplitude modulation signal as 180° from the phase of the first amplitude modulation signal. The phase control unit 40 supplies the second amplitude modulation signal and the third amplitude modulation signal to the amplification unit 50.

The amplification unit 50 obtains the second amplitude modulation signal and the third amplitude modulation signal. By amplifying an amplitude of the second amplitude modulation signal and the third amplitude modulation signal, the amplification unit 50 generates a fourth amplitude modulation signal and a fifth amplitude modulation signal. Here, the fourth amplitude modulation signal is the second amplitude modulation signal of which amplitude is amplified. The fifth amplitude modulation signal is the third amplitude modulation signal of which amplitude is amplified. The amplification unit 50 supplies the fourth amplitude modulation signal to the first parametric loudspeaker 60, and supplies the fifth amplitude modulation signal to the second parametric loudspeaker 70.

Moreover, the amplification unit 50 amplifies the amplitude modulation signal so that the sound wave having an intensity (For example, amplitude: larger than 120 dB) to occur non-linear phenomenon of the air is amplified to a level to radiate from the parametric loudspeaker. Furthermore, preferably, the amplification unit 50 amplifies the second amplitude modulation signal and the third amplitude modulation signal so that a sound pressure of the first audible sound is equal to a sound pressure of the second audible sound at the control point.

The first parametric loudspeaker 60 obtains the fourth amplitude modulation signal, and radiates a first sound wave toward the control point, based on the fourth amplitude modulation signal. For example, the first parametric loudspeaker 60 has a circular radiation surface having the first area. The first sound wave is radiated from this radiation surface. The first sound wave radiated from the first parametric loudspeaker 60 is demodulated, and then a first audible sound arises. After that, as to a plurality of sections horizontal to the radiation surface of the first parametric loudspeaker 60, the first audible sound has an axis (the directional axis) A connecting points at which the sound pressure thereof is maximum on each section. Here, the directional axis A is same as a normal line passing through a center of the radiation surface. Furthermore, here, a control point (previously determined) is located at a position on the direction axis A. Accordingly, the first parametric loudspeaker 60 radiates the first sound wave toward the control point positioned on a direction X1 as one direction of the directional axis A.

Figure 2:
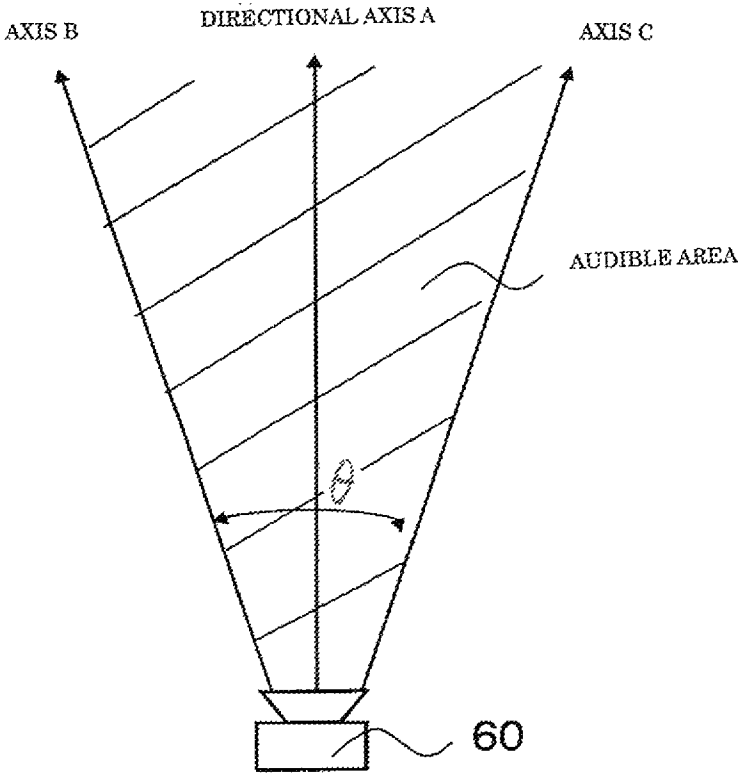
FIG. 2 is a schematic diagram to explain a listening area of a first parametric loudspeaker according to the first embodiment.

In this case, as shown in FIG. 2, the first parametric loudspeaker 60 generates an area (the audible area) surrounded by two axes B and C having a half-value angle θ centering around the directional axis A on the horizontal surface. The listener had better listen within this audible area. Moreover, the half-value angle is an angle between two axes on which the sound pressure is attenuated to a half thereof on the directional axis A. Here, for example, the direction X1 and the half-value angle θ can be previously set based on the listener's listening position.

The second parametric loudspeaker 70 obtains the fifth amplitude modulation signal, and radiates a second sound wave based on the fifth amplitude modulation signal. For example, the second parametric loudspeaker 70 has a circular radiation surface having the second area. The second sound wave is radiated from this radiation surface. Here, the second area is equal to the first area of the first parametric loudspeaker 60. The second sound wave radiated from the second parametric loudspeaker 70 is demodulated, and then a second audible sound arises. After that, as to a plurality of sections horizontal to the radiation surface of the second parametric loudspeaker 70, the second audible sound has an axis (the directional axis) D connecting points at which the sound pressure thereof is maximum on each section. Here, the directional axis D is same as a normal line passing through a center of the radiation surface.

The second parametric loudspeaker 70 is located so that the directional axis D is matched (coincides) with the directional axis A of the first parametric loudspeaker 60, and so that the radiation surface is toward a direction X2 opposite to the direction X1 along the directional axes A and D. Accordingly, the second parametric loudspeaker 70 radiates the second sound wave toward the direction X2. Moreover, in following explanation, the direction axes A and D are called a direction axes altogether.

Figure 3:
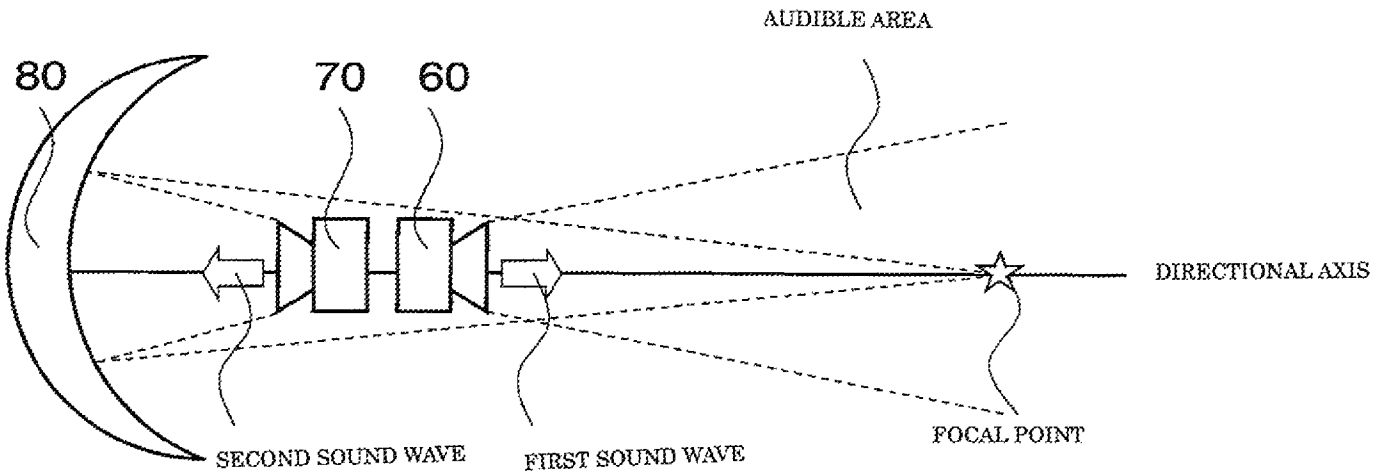
FIG. 3 is a schematic diagram to explain a focal point of a second sound wave according to the first embodiment.

A reflection unit 80 is located by opposing to a radiation surface of the second parametric loudspeaker 70, which is a curved material having a concave toward the radiation surface of the second parametric loudspeaker 70. The concave receives a sound wave and reflects the sound wave toward the control point. Specifically, the reflection unit 80 is located so that a focal point of the sound wave reflected by the concave is matched (coincides) with the control point. In the reflection unit 80, the second sound wave radiated from the second parametric loudspeaker 70 is reflected by the concave. As shown in FIG. 3, the second sound wave (the second audible sound) reflected by the concave of the reflection unit 80 is focused onto the focal point. As a result, a sound pressure-distribution of the second audible sound has a maximum (peak point) at the focal point, i.e., the control point. As a material of the reflection unit 80, any material to reflect an ultrasonic may be used, for example, metal can be used.

In the first embodiment, as the concave (reflection surface) of the reflection unit 80, an ellipsoid of revolution acquired by revolving an ellipse around a major axis thereof is applied. By using characteristic as the quadratic curve, a position of the focal point is set. In this case, as to the ellipse having two focuses, characteristic thereof is used, i.e., by reflecting a sound wave radiated from one focus, the sound wave is focused onto another focus.

Accordingly, as to two focuses of the ellipsoid of revolution of the reflection unit 80, the reflection unit 80 is located so that the second parametric loudspeaker 70 is positioned at a first focus nearer from the reflection unit 80 and so that the control point is matched (coincides) with a second focus farther from the reflection unit 80. Briefly, the second focus (control point) and the focal point are mutually matched. As a result, the sound pressure-distribution of the second audible sound has a maximum (peak point) at the second focus (control point) in the audible area.

Figure 4:
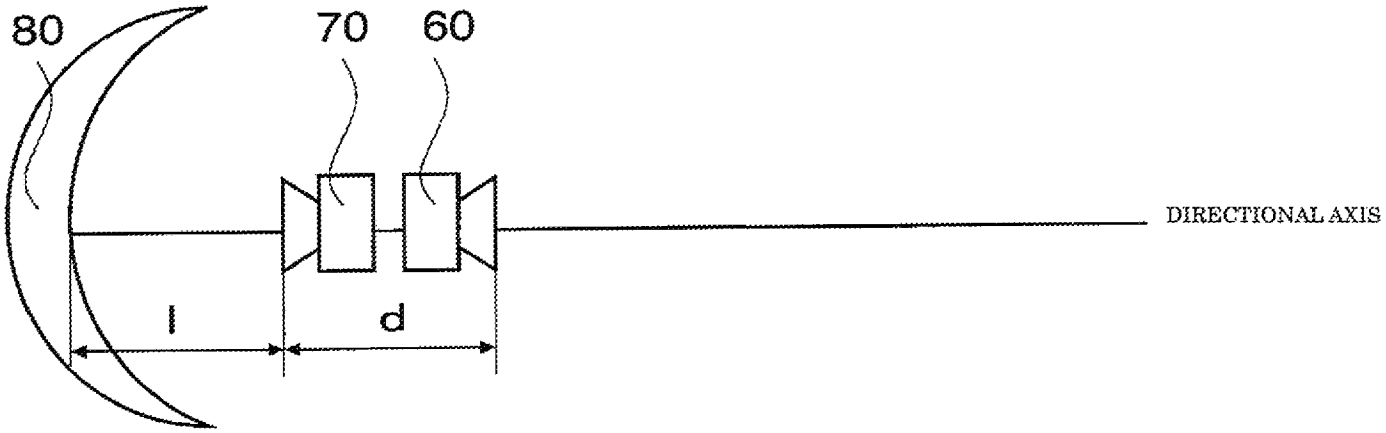
FIG. 4 is a schematic diagram to explain positions where the first parametric loudspeaker and a second parametric loudspeaker according to the first embodiment.

Moreover, as shown in FIG. 4, due to positions where the first parametric loudspeaker 60 and the second parametric loudspeaker 70 are set, a path length difference occurs between the first audible sound and the second audible sound. Accordingly, by adding the path length difference, the phase control unit 40 generates the second amplitude modulation signal and the third amplitude modulation signal based on positional relationship among the first parametric loudspeaker 60, the second parametric loudspeaker 70, and the reflection unit 80.

A time phase difference $\Delta t_1$[s] between the first audible sound and the second audible sound, which is occurred due to the path length difference therebetween, is represented as following equation.

$$\Delta t_1 = \frac{2l + d}{c_0} \tag{3}$$

l: distance [m] between second parametric loudspeaker and reflection unit d: distance [m] between first parametric speaker and second parametric speaker $c_0$: speed of sound[m/s] in air (For example, 340 [m/s] at temperature 15° C.)

For example, if an angle phase difference between the first audible sound and the second audible sound is 180°, the time phase difference Δt represented by following equation is given to the first audible sound and the second audible sound. In the equation (4), $\Delta t_1$ occurred due to the path length difference (represented by the equation (3)) is added to $\Delta t_2$ to change the angle phase difference as 180°. Here, $f_s$ is a frequency of the first acoustic signal.

$$\Delta t = \Delta t_1 + \Delta t_2 = \frac{2l + d}{c_0} + \frac{1}{2f_s} \tag{4}$$

Hereinafter, by referring to FIG. 5, function of the acoustic apparatus 100 is explained.

Figure 5:
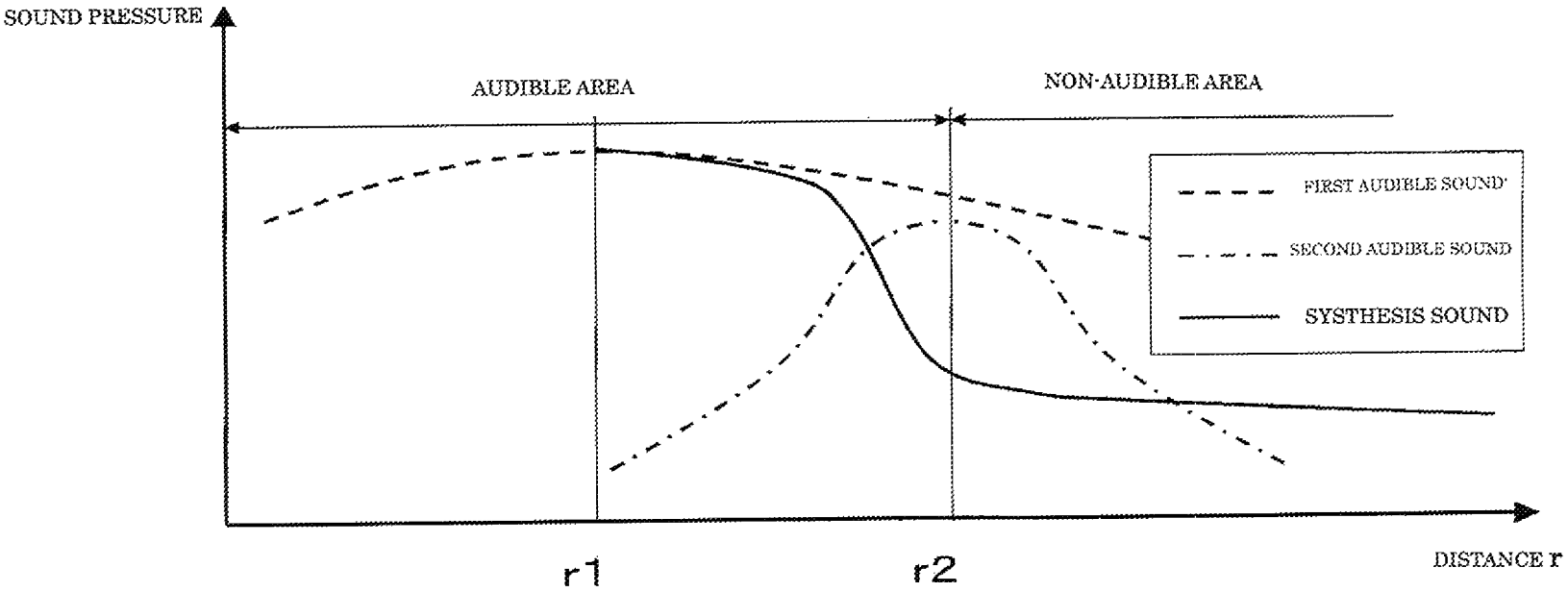
FIG. 5 is a schematic diagram to explain a function of the acoustic apparatus according to the first embodiment.

FIG. 5 is a schematic diagram to show the sound pressure-distribution of the first audible sound and the second audible sound along the directional axis. Moreover, in FIG. 5, a distance r as the horizontal axis represents a distance along which the first audible sound is propagated on the directional axis from the origin (a position of the first parametric loudspeaker 60).

As shown in FIG. 5, as to the first audible sound, a sound pressure thereof increases with a longer distance of propagation. At the distance r1, the sound pressure has a maximum. Then, after from the distance r1, the sound pressure gradually attenuates. Furthermore, as to the second audible sound, a sound pressure thereof has a maximum at a distance r2 (the control point). The sound pressure-distribution shapes a chevron centering around the control point. Briefly, when the distance is more departed from the control point, the sound pressure of the second audible sound attenuates steeply in comparison with the sound pressure of the first audible sound. In this way, by reflecting the second sound wave with the reflection unit 80, characteristic of sound pressure-distribution (demodulated from the second sound wave) more changes in comparison with sound pressure-distribution demodulated from the second sound wave not reflected. Accordingly, as to the first audible sound and the second audible sound, characteristics of sound pressure-distribution thereof are different.

Here, by interfering these two audible sounds (having different characteristics of sound pressure-distribution) in an audible area, based on a position of the first parametric loudspeaker 60 in the audible area, the sound pressure can be sufficiently maintained in an area nearer from the control point, and can be attenuated steeply at the control point. As mentioned-above, after a sound pressure of the first audible sound attenuates steeply once, it is confirmed that the sound pressure is maintained low level. In an area farther from the control point, the sound pressure can be sufficiently attenuated. Briefly, by bounding the control point, the listening area and the non-listening area can be separated. Hereinafter, this processing is explained in detail.

A phase difference between the first audible sound and the second audible sound is 180° (or approximately 180°). Accordingly, by interfering the first audible sound and the second audible sound, a sound pressure of the first audible sound is cancelled. As shown in FIG. 5, on a distance r shorter than the distance r2 ($r<r2$), a difference of sound pressure between the first audible sound and the second audible sound is large. As a result, the sound pressure of the first audible sound is dominant, and a sound pressure of a synthesis sound is almost equal to the sound pressure of the first audible sound. On a distance r longer than (or equal to) the distance r2 ($r\geq r2$), the second audible sound has a maximum sound pressure. A difference of sound pressure between the first audible sound and the second audible sound is small. As a result, at the distance r2, a sound pressure of the synthesis sound attenuates steeply. Briefly, the sound pressure-distribution of the second audible sound shapes a chevron centering around the distance r2 at which the sound pressure is maximum. Accordingly, even if the sound pressure of the first audible sound is canceled, the sound pressure can be sufficiently maintained on a distance shorter than the distance r2, and can be attenuated steeply on a distance longer than (or equal to) the distance r2. In this case, an area along a distance shorter than the distance r2 is the listening area for a listener to listen, and an area along a distance longer than (or equal to) the distance r2 is the non-listening area.

According to the acoustic apparatus 100 of the first embodiment, in the listening area, the sound pressure can be sufficiently maintained. Furthermore, in the non-listening area, the sound pressure can be attenuated steeply. Here, by using an ellipsoid of revolution as the concave (reflection surface) of the reflection unit 80, a focusing efficiency of the second sound wave can be improved at a focal point (the control point). Here, the focusing efficiency is a ratio of the sound pressure at the focal point to a sound pressure at a sound source. Furthermore, the sound pressure of the synthesis sound can be more reduced at the focal point (the control point). As a result, the listening area and the non-listening area can be clearly separated.

Moreover, in the first embodiment, an example that a directional axis A of the first parametric loudspeaker 60 is matched with a directional axis D of the second parametric loudspeaker 70 is already explained. However, the directional axis A and the directional axis D are not always matched. The first parametric loudspeaker 60 and the second parametric loudspeaker 70 may be located so that a focal point of the second sound wave (the second audible sound) is matched with the control point in the audible area of the first parametric loudspeaker 60.

(Modification)

In the modification, as the concave (reflection surface) of the reflection unit 80, a paraboloid of revolution acquired by revolving a parabola around a symmetric axis is applied. By using characteristic as the quadratic curve, a position of focal point is set. In this case, based on the side of the parabola, a sound wave radiated from a position nearer than a focus of the parabola is reflected and diffused. On the other hand, a sound wave radiated from a position farther than the focus is focused into a predetermined area. This characteristic is utilized. Here, a position at which the sound pressure-distribution of the second audible sound is maximum (peak point) is a focal point.

In this case, for example, positional relationship among the second parametric loudspeaker 70, the reflection unit 80, and the focal point, can be previously examined by a previous experiment or a simulation. Based on this relationship previously examined, the reflection unit 80 is set so that the focal point is matched with the control point. As a result, the sound pressure-distribution of the second audible sound has a maximum (peak) at the focal point (the control point) in the audible area.

The Second Embodiment

Figure 6:
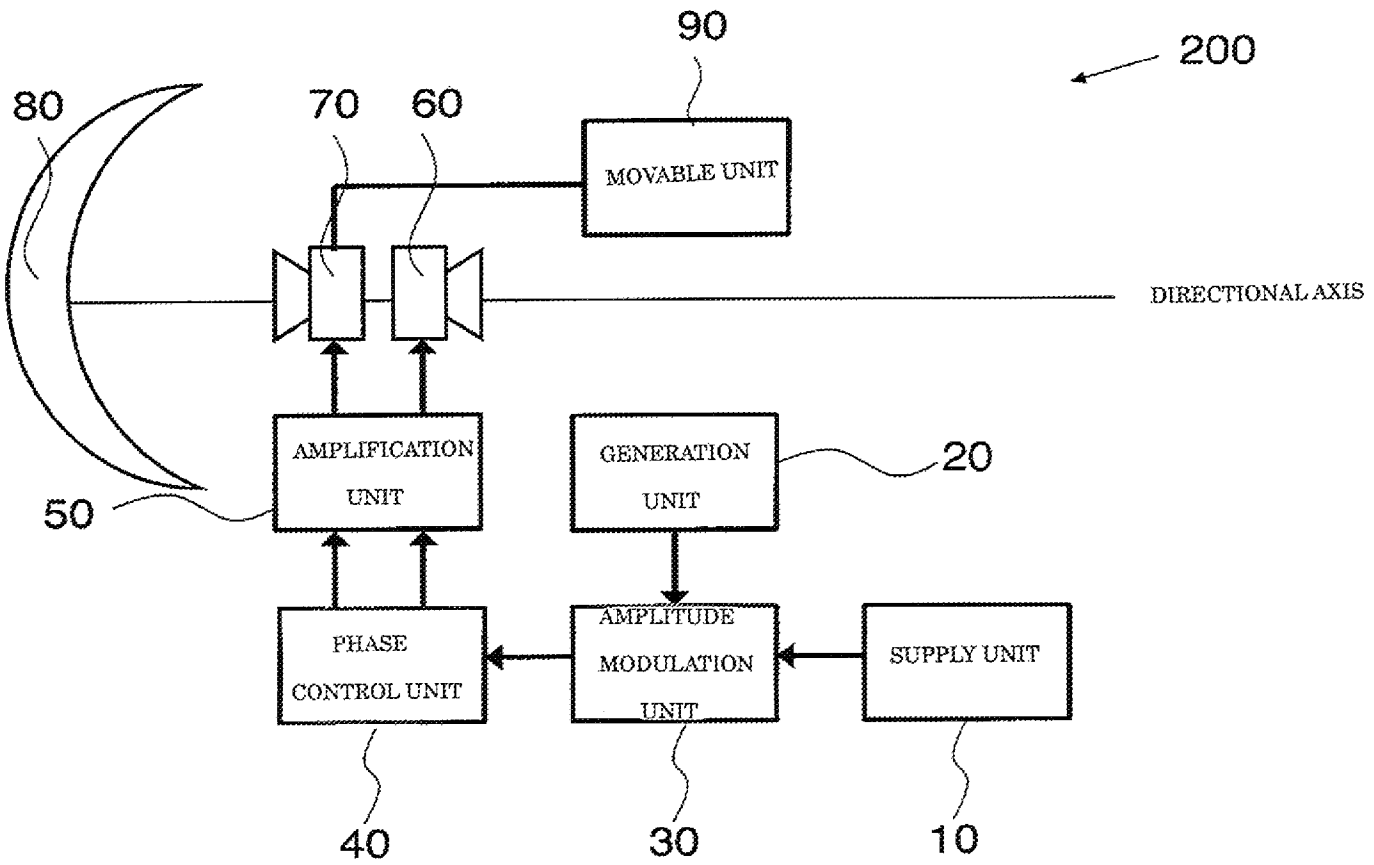
FIG. 6 is a block diagram of an acoustic apparatus according to a second embodiment.

FIG. 6 is a block diagram of an acoustic apparatus 200 of the second embodiment.

In FIG. 6, the acoustic apparatus 200 includes a movable unit 90 to move the second parametric loudspeaker 70 between the first parametric loudspeaker 60 and the reflection unit 80 along the directional axis. As the movable unit 90, for example, conventional technique such as a linear moving mechanism can be used. Accordingly, detail explanation thereof is omitted. Furthermore, as the concave (reflection surface) of the reflection unit 80, a paraboloid of revolution is used.

Figure 7:
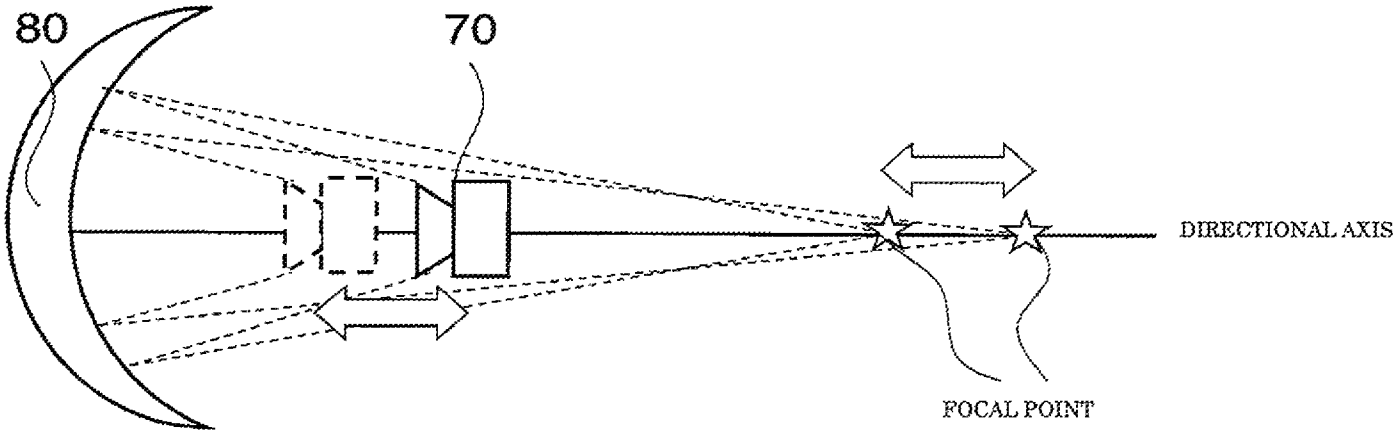
FIG. 7 is a schematic diagram to explain a focal point of a second sound wave according to the second embodiment.

In the acoustic apparatus 200, the movable unit 90 moves the second parametric loudspeaker 70 along the directional axis. As shown in FIG. 7, a focal point of the second sound wave (the second audible sound) is moved along the directional axis. Briefly, when the second parametric loudspeaker 70 is moving nearer to the reflection unit 80, the focal point of the second sound wave (the second audible sound) is moving farther from the reflection unit 80 along the directional axis. Furthermore, when the second parametric loudspeaker 70 is moving farther from the reflection unit 80, the focal point of the second sound wave (the second audible sound) is moving nearer to the reflection unit 80 along the directional axis.

As a result, the focal point of the second sound wave (the second audible sound), i.e., a position at which sound pressure of synthesis sound attenuates steeply, can be moved along the directional axis. As a result, a distance (a boundary)

between the listening area and the non-listening area can be controlled. In other words, a range of the listening area can be controlled.

The Third Embodiment

Figure 8:
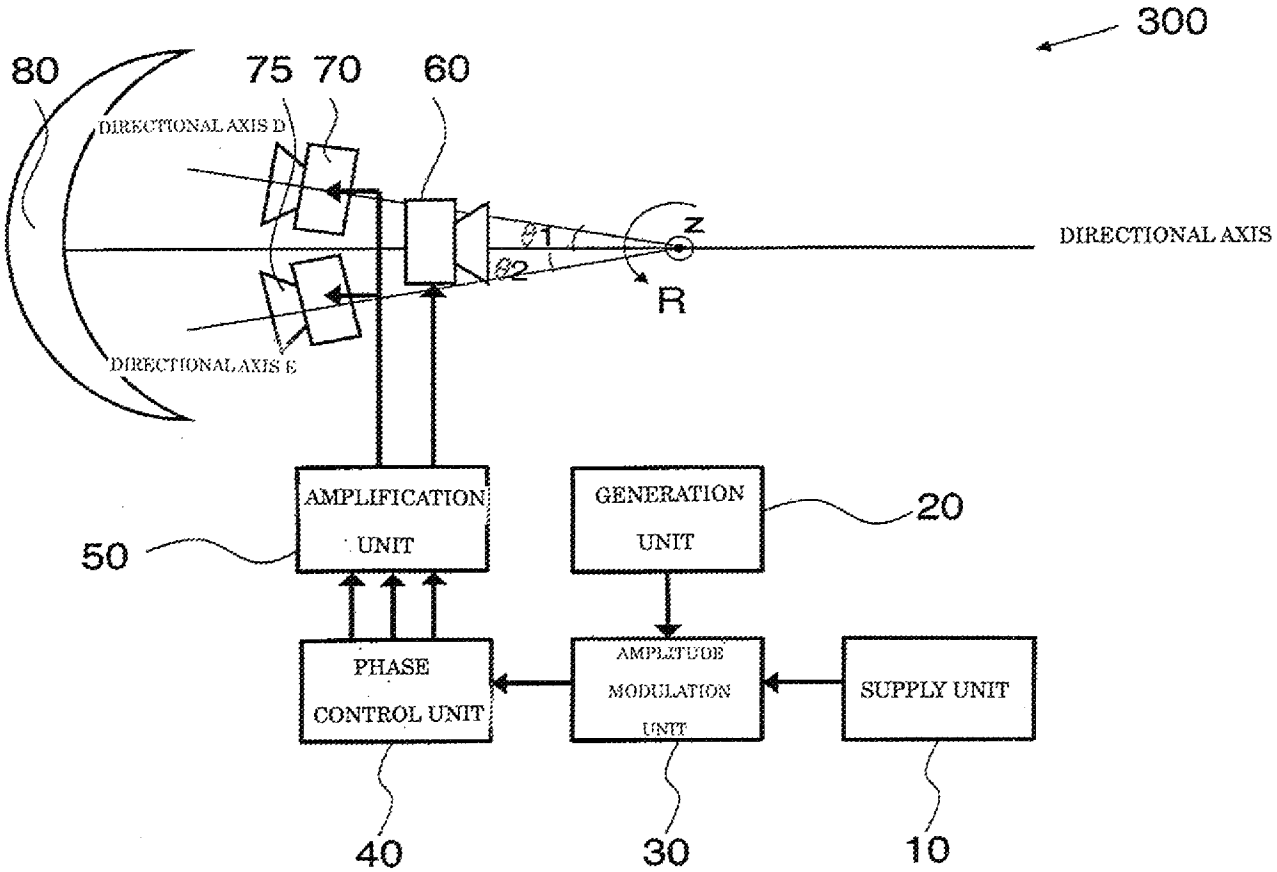
FIG. 8 is a block diagram of an acoustic apparatus according to a third embodiment.

FIG. 8 is a block diagram of an acoustic apparatus 300 of the third embodiment.

In the acoustic apparatus 300 of FIG. 8, in addition to the second amplitude modulation signal and the third amplitude modulation signal, when they are overlapped, the phase control unit 40 generates a sixth amplitude modulation signal having a phase opposite to the second amplitude modulation signal. Furthermore, the amplification unit 50 obtains the sixth amplitude modulation signal. By amplifying amplitude of the sixth amplitude modulation signal, the amplification unit 50 generates a seventh amplitude modulation signal.

The second parametric loudspeaker 70 is set so that a directional axis A of the first parametric loudspeaker 60 and a directional axis D of the second parametric loudspeaker 70 cross with an angle −θ1 around z-axis in FIG. 8. Here, in FIG. 8, the angle revolving along R-direction around z-axis is defined as a positive value.

The third parametric loudspeaker 75 obtains the seventh amplitude modulation signal, and radiates a third sound wave based on the seventh amplitude modulation signal. For example, the third parametric loudspeaker 75 has a circular radiation surface having the third area. The third sound wave is radiated from this radiation surface. Here, the third area is equal to the second area of the second parametric loudspeaker 70. The third sound wave radiated from the third parametric loudspeaker 75 is demodulated, and then a third audible sound arises. After that, as to a plurality of sections horizontal to the radiation surface of the third parametric loudspeaker 75, the third audible sound has an axis (the directional axis) E connecting points at which the sound pressure thereof is maximum on each section. Here, the directional axis E is same as a normal line passing through a center of the radiation surface.

Furthermore, the third parametric loudspeaker 75 is set so that the directional axis A of the first parametric loudspeaker 60 and the directional axis E of the third parametric loudspeaker 75 cross with an angle θ2 around z-axis in FIG. 8. Here, in FIG. 8, the angle revolving along R-direction around z-axis is defined as a positive value. In the third embodiment, assume that "θ2=θ1".

The reflection unit 80 reflects so that respective focal points of the second sound wave (the second audible sound) and the third sound wave (the third audible sound), i.e., respective maximum points (peak) of sound pressure of the second audible sound and the third audible sound, are included in an audible area of the first parametric loudspeaker 60. Here, for example, by previously setting two control points (a first control point and a second control point), the reflection unit 80 is set so that respective focal points of the second sound wave (the second audible sound) and the third sound wave (the third audible sound) are matched with the two control points. In this example, one reflection unit 80 is set. However, two reflection units may be set. Specifically, a first reflection unit has a first concave to receive the second sound wave and reflect the second sound wave toward the first control point. A second reflection unit has a second concave to receive the third sound wave and reflect the third sound wave toward the second control point. Briefly, a focal point of the second sound wave reflected by the first concave is the first control point, and a focal point of the third sound wave reflected by the second concave is the second control point.

Figure 9:
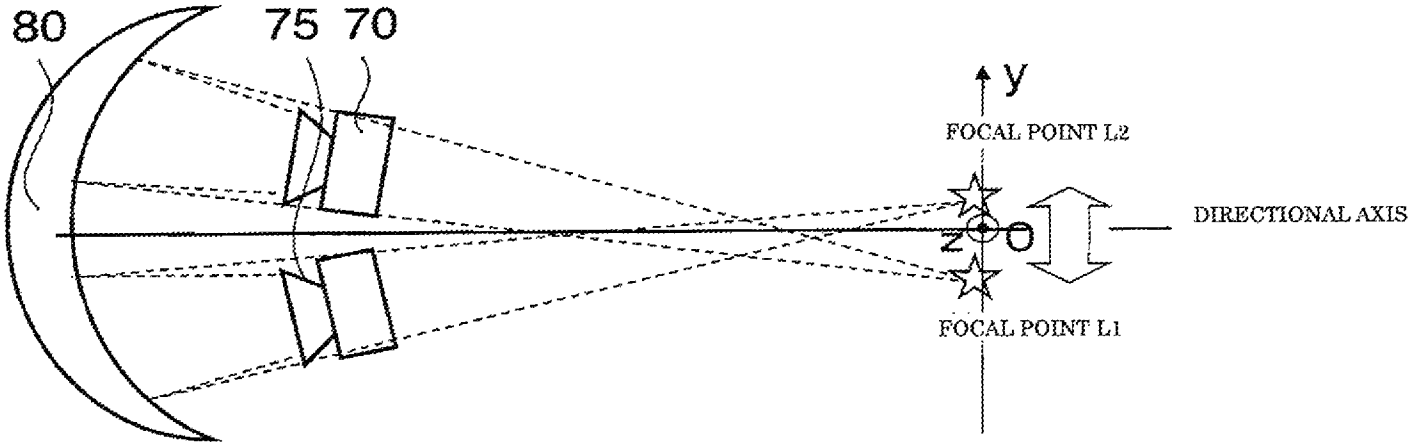
FIG. 9 is a schematic diagram to explain a focal point of a second sound wave and a third sound wave according to the third embodiment.

Here, as shown in FIG. 9, a focal point L1 of the second sound wave (the second audible sound) and a focal point L2 of the third sound wave (the third audible sound) are respectively shifted along y-axis perpendicular to the directional axis A of the first parametric loudspeaker 60.

Figure 10:
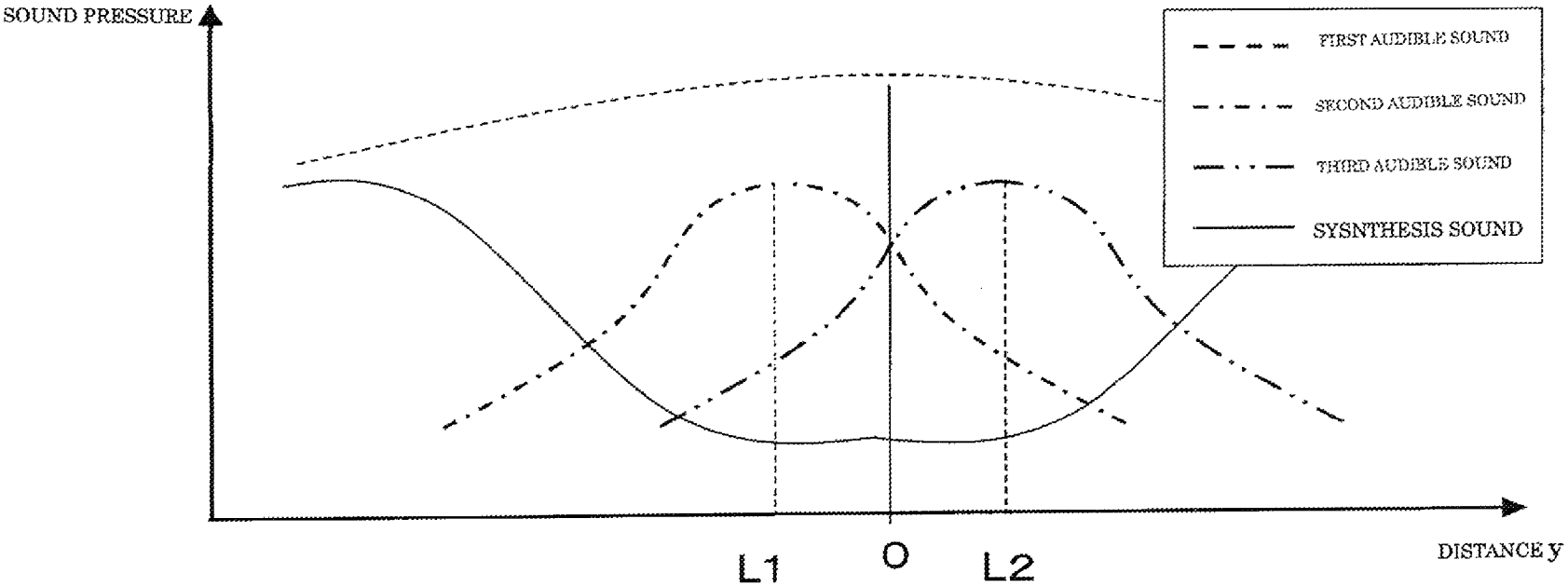
FIG. 10 is a schematic diagram to explain a function of the acoustic apparatus according to the third embodiment.

FIG. 10 shows sound pressure-distribution of synthesis sound (the first audible sound, the second audible sound, the third audible sound) along y-axis, at the distance r2 along the directional axis having the focal points L1 and L2. Here, respective phases of the second audible sound and the third audible sound have a difference 180° (or approximately 180°) from a phase of the first audible sound. Accordingly, as shown in FIG. 10, by synthesizing the first audible sound, the second audible sound and the third audible sound, the sound pressure of the first audible sound along y-axis is canceled.

As a result, an area where sound pressure of synthesis sound attenuates steeply, i.e., a range of the non-listening area, can be enlarged along y-axis. Accordingly, the listening area and the non-listening area can be clearly separated along y-axis.

Moreover, in the third embodiment, two loudspeakers (the second parametric loudspeaker 70, the third parametric loudspeaker 75) are used. However, more than two parametric loudspeakers of which directional axes are different may be used.

Furthermore, in the third embodiment, the second parametric loudspeaker 70 and the third parametric loudspeaker 75 are located in a plane. However, if at least three parametric loudspeakers are used, they may be located in a space, i.e., along z-axis in FIG. 8.

Furthermore, in the acoustic apparatus 100 of FIG. 1, the second area of a radiation surface of the second parametric loudspeaker 70 may be larger than the first area of a radiation surface of the first parametric loudspeaker 60. As a result, by enlarging the focal point of the second sound wave (the second audible sound) along y-axis, a range of the non-listening area can be enlarged along y-axis, in the same way as the at least three parametric loudspeakers.

The Fourth Embodiment

Figure 11:
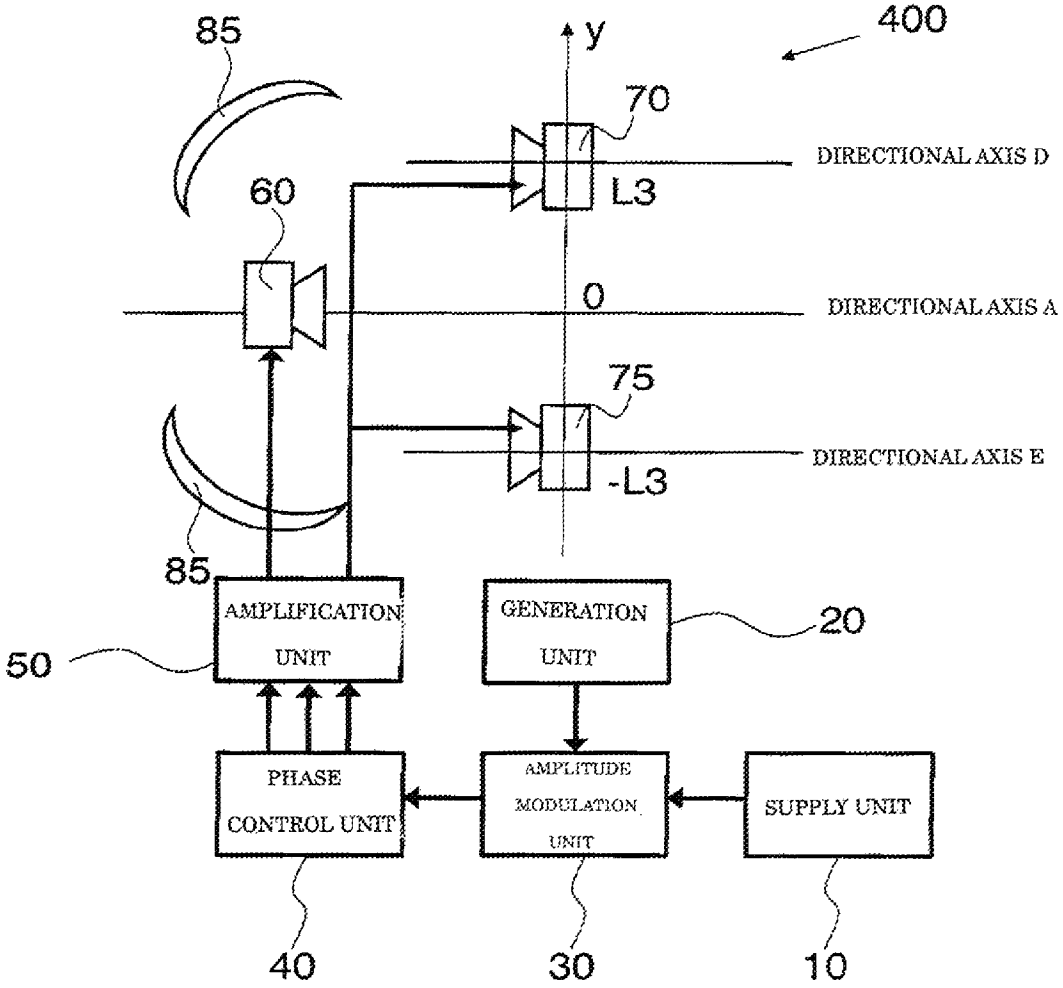
FIG. 11 is a block diagram of an acoustic apparatus according to a fourth embodiment.

FIG. 11 is a block diagram of an acoustic apparatus 400 of the fourth embodiment.

In the acoustic apparatus 400 of FIG. 11, the second parametric loudspeaker 70 and the third parametric loudspeaker 75 are located so that directional axes D and E are shifted along y-axis direction for the directional axis A of the first parametric loudspeaker 60, in parallel with the directional axis A. Here, at a position of distance L3 along y-axis direction in FIG. 11, the second parametric loudspeaker 70 is located. Furthermore, at a position of distance −L3 along y-axis direction, the third parametric loudspeaker 75 is located.

In this case, as the concave (reflection surface) of the reflection unit 85, an off-axis paraboloid is used. As a result, even if directional axes of the first parametric loudspeaker 60, the second parametric loudspeaker 70 and the third parametric loudspeaker 75, are not matched, the reflection unit 85 can reflect so that respective focal points of the second sound wave (the second audible sound) and the third sound wave (the third audible sound), i.e., respective maximum points (peak) of sound pressure of the second audible sound and the third audible sound, are included in an audible area of the first parametric loudspeaker 60.

According to the acoustic apparatus 400 of the fourth embodiment, respective directional axes of the second parametric loudspeaker 70 and the third parametric loudspeaker 75 are shifted along y-axis direction for the directional axis of the first parametric loudspeaker 60. In this case, after the second audible sound and the third audible sound are reflected by the reflection unit 85 and demodulated, the second audible sound and the third audible sound are not obstructed by the first parametric loudspeaker 60. Accordingly, it is prevented that peaks of the sound pressure thereof are reduced by the obstruction. As a result, the sound pressure of synthesis sound can be more attenuated in the non-listening area. Moreover, as the concave (reflection surface) of the reflection unit 85, an off-axis ellipsoid may be used.

As mentioned-above, according to the acoustic apparatus of at least one of the first, second, third and fourth embodiments, the sound pressure can be sufficiently maintained in the listening area, while the sound pressure can be attenuated steeply in the non-listening area.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An acoustic apparatus comprising:

an amplitude modulation unit configured to generate a first signal by modulating an amplitude of a carrier wave signal having a frequency of an ultrasonic band, based on an acoustic signal;

a phase control unit configured to generate a second signal and a third signal by controlling a phase of the first signal, respective phases of the second signal and the third signal being approximately opposite;

an amplification unit configured to amplify the second signal and the third signal;

a first parametric loudspeaker configured to radiate a first sound wave toward a first control point located on a directional axis of the first parametric loudspeaker, based on the amplified second signal, the directional axis being a normal line passing through a center of a radiation surface of the first parametric loudspeaker;

a first reflection unit having a first concave to receive a sound wave and reflect the sound wave toward the first control point, a focal point of the sound wave reflected by the first concave being the first control point; and a second parametric loudspeaker configured to radiate a second sound wave toward the first concave, based on the amplified third signal, wherein the amplification unit amplifies the second signal and the third signal so that a sound pressure of the first sound wave is approximately equal to a sound pressure of the second sound wave at the first control point.

2. The acoustic apparatus according to claim 1, wherein the first concave is an ellipsoid of revolution having a first focus and a second focus, the second focus is positioned at the first control point, and the second parametric loudspeaker is located at a position of the first focus.

3. The acoustic apparatus according to claim 1, wherein the first concave is a paraboloid of revolution having a first focus, and the first reflection unit is located so that a sound pressure-distribution of the second sound wave reflected by the first concave is maximum at the first control point.

4. The acoustic apparatus according to claim 3, wherein the second parametric loudspeaker has an axis along a direction to radiate the second sound wave, and the axis is matched with a symmetric axis of the paraboloid of revolution, further comprising:

a movable unit configured to move the second parametric loudspeaker along the axis.

5. The acoustic apparatus according to claim 1, wherein the phase control unit generates a fourth signal by controlling the phase of the first signal, a phase of the fourth signal is approximately opposite to a phase of the second signal, and the first parametric loudspeaker radiates the first sound wave toward a second control point, further comprising:

a second reflection unit having a second concave to receive a sound wave and reflect the sound wave toward the second control point, a focal point of the sound wave reflected by the second concave being the second control point; and a third parametric loudspeaker configured to radiate a third sound wave toward the second concave, based on the fourth signal.

6. The acoustic apparatus according to claim 5, wherein the amplification unit amplifies the fourth signal.

7. The acoustic apparatus according to claim 1, wherein the frequency of the ultrasonic band is larger than or equal to 20 kHz.

8. The acoustic apparatus according to claim 1, wherein the phase of the first signal is equal to any of a phase of the second signal or a phase of the third signal.

* * * * *